United States Patent [19]

Mayer

[11] 4,116,099

[45] Sep. 26, 1978

[54] HOUSEHOLD APPLIANCE DRIVEN BY AN ELECTRIC MOTOR, ESPECIALLY SLICING MACHINE FOR FOODS

[75] Inventor: Rolf Mayer, Giengen, Germany

[73] Assignee: Bosch-Siemens Hausgeräte GmbH, Stuttgart, Germany

[21] Appl. No.: 810,206

[22] Filed: Jun. 27, 1977

[30] Foreign Application Priority Data

Jun. 30, 1976 [DE] Fed. Rep. of Germany ..... 2629352

[51] Int. Cl.[2] ..... B26D 4/28; B26D 7/00

[52] U.S. Cl. ..... 83/571; 83/707

[58] Field of Search ..... 83/703, 707, 573, 572, 83/571

[56] References Cited

U.S. PATENT DOCUMENTS

| | | | |
|---|---|---|---|
| 2,946,362 | 7/1960 | Aberer et al. | 83/571 |
| 3,759,129 | 9/1973 | Bricker et al. | 83/571 X |

FOREIGN PATENT DOCUMENTS

| | | | |
|---|---|---|---|
| 2,241,961 | 3/1975 | France | 83/707 |
| 1,134,485 | 8/1962 | Fed. Rep. of Germany | 83/707 |
| 2,343,287 | 3/1975 | Fed. Rep. of Germany | 83/707 |
| 2,345,688 | 3/1975 | Fed. Rep. of Germany | 83/703 |

*Primary Examiner*—Willie G. Abercrombie
*Attorney, Agent, or Firm*—Herbert L. Lerner

[57] ABSTRACT

Household appliance driven by an electric motor, especially a slicing machine for food, having a housing with a recess, a separate drive housing with the electric-motor drive mounted in and enclosed by the drive housing together with various switching and control elements controlling the operation and or speed of the drive, forming a unitary drive block, with the unitary drive block attached to the housing in the recess, and with the unitary drive block readily detached to facilitate cleaning of the housing of the appliance and the circular blade.

4 Claims, 6 Drawing Figures

HOUSEHOLD APPLIANCE DRIVEN BY AN ELECTRIC MOTOR, ESPECIALLY SLICING MACHINE FOR FOODS

BACKGROUND OF THE INVENTION

1. Field of the Invention

This invention relates to a household appliance driven by an electric motor, such as a slicing machine for food, having a housing with an electric-motor drive mounted therein as well as various switching and control elements controlling the operation and the speed of the drive and a tool such as circular blades or the like acted on by a drive.

2. Description of the Prior Art

In known household applicances of the type mentioned it is customary to construct the equipment for its electric-motor drive permanently built into the housing. In practice it was found that such appliances had a significant disadvantage in that the housing with built-in electric-motor drive can be wet cleaned only with the greatest caution and then only imperfectly. Indeed, it is impossible to wash the housing with the built-in electric-motor drive of the known household appliances properly by hand, and this applies even more emphatically to washing in a dishwasher.

If one wanted to alter the conventional appliances to enable them to be cleaned in a dishwasher, elaborate sealing measures would be required which would raise the cost of the known appliances enormously. In most of the known household appliances it is not possible to arrange the elements of the electric-motor drive in a watertight manner so that they can be safely washed because of the slots in the housing which are required for ventilating the motor.

Even though the food may not come into direct contact with the housing in some household appliances and occasional washing of the housing may not seem absolutely necessary, it has been found nevertheless that it would be highly desirable in the case of electric-motor-driven household slicers, which just recently have become increasingly popular in modern households, to completely wash them for hygienic reasons. This washing is particularly needed because, behind the circular blade and the section of the housing wall covered by it are cavities in which moist food residue wiped off the revolving blade collects. This moist food residue, protected from drying out, forms a nutrient medium for bacteria and mold.

SUMMARY OF THE INVENTION

It is therefore an object of the invention to provide a household appliance driven by an electric motor and in particular, a household slicer, in which not only simple cleaning but also washing of the housing is possible. For reasons of hygienic and intensive cleaning, this includes washing in a modern dishwasher.

With the foregoing and other objects in view, there is provided in accordance with the invention, a household appliance driven by an electric motor, such as a slicer for food, having a housing for the household appliance and an electric-motor drive mounted therein, as well as switching and control elements controlling the operation, and a tool, such as circular blades and the like, that can be moved by the electric-motor drive and acts on the food to be operated on, the electric-motor drive mounted in and enclosed in a separate housing of its own as a unitary drive block, with the unitary drive block attached to the housing of the household appliance and with the unitary drive block readily detached from the housing of the household appliance to facilitate cleaning of the housing and tool.

Other features which are considered as characteristic for the invention are set forth in the appended claims.

Although the invention is illustrated and described herein as embodied in a household appliance driven by an electric motor, especially slicing machine for foods, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
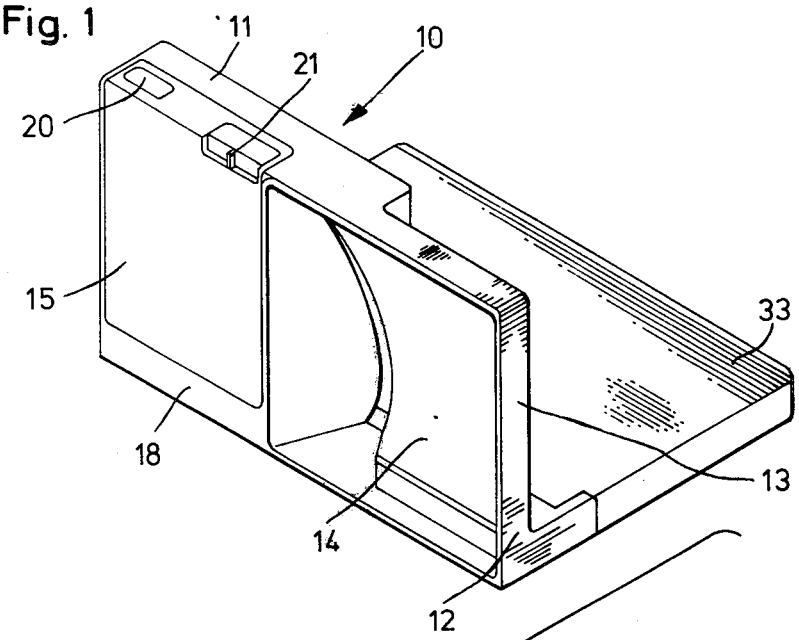
FIG. 1 shows a perspective view of a household slicer which has a circular blade and which is driven by a detachable drive block and is enclosed by a box-like housing with a work plate that can be folded down.
Figure 2:
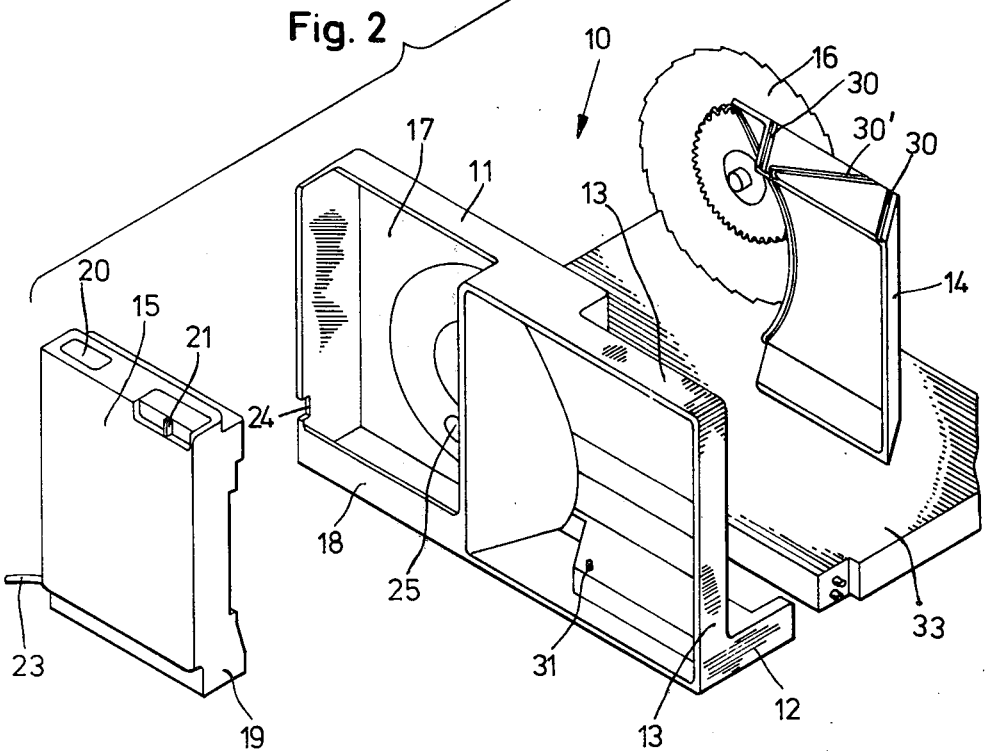
FIG. 2 is an exploded perspective view of the household slicer shown in FIG. 1.

The drive is designed as a unified drive block or "power block" which is enclosed in its own housing and which can be attached with a tight fit to the housing of the household appliance. With the household appliance equipped with the features according to the invention, the drive block may be detached from the housing in a simple manner after the revolving blade is taken off. Then the housing is washed normally without difficulty.

The housing, which has cavities and/or recesses, is designed so that, at least in one preferred position, water running off the housing can flow off unimpeded and will not be retained in a cavity or recess. The housing is particularly well adapted for cleaning in a dishwasher because water does not become trapped on or in the housing.

The housing appliance has an at least approximately prismatic housing standing on edge. The housing at the flank where the tool is mounted has a recess on the side opposite the tool. Into this recess is inserted with a close fit the drive block having an at least approximately prismatic shape. As a result the unitary drive block, which is enclosed in a housing of its own, may be simply detached, if required, from the remainder of the household appliance equipment. The recess is provided at its lower portion associated with the base of the housing, with a border member which, together with adjacent sections of the housing, forms a case-like receptacle, in which the housing of the drive block engages with a correspondingly shaped lower section.

A connecting part which connects the circular blade mounted on the outside of a wall of its housing has a bayonet joint. The connecting part connects on the one hand the revolving blade and on the other hand, the unified drive block mounted on the other side of the wall to the housing in tensionally connected manner. In a household appliance equipped in this manner, the circular blade and the drive block can be assembled and disassembled, if required, particularly simply and quickly with only one manipulation.

The unit containing the drive block has all elements for electrically and mechanically influencing the drive. In this manner, otherwise necessary plug connections can be dispensed with and faults and trouble due to unreliable contact of plug connections can be eliminated. The drive block may be equipped with a wind-up device for a power cord that can be connected to the electric power line.

Referring to the drawings, a household slicer designated by numeral 10 comprises a housing 11, which in general is of prismatic shape and, in the operating position, rests on a base 12 which extends sideways. The housing 11 has a frame-like section 13, in which a movable stop plate 14 is mounted. On the side of the housing 11 opposite the frame-like section 13 is mounted a drive block 15 which serves to drive the household slicer 10 and which drives a circular blade 16 provided with a gear rim.

The drive block 15 is designed, as can be seen particularly from FIGS. 2 and 4 to 6, as a unified body which is enclosed in a housing of its own and can be attached, in tightly fitting manner and also easily detachable, to the housing 11 of the household slicer 10. For this purpose, the housing 11 has a recess 17 on the side opposite the circular blade 16, into which the approximately prismatic drive block 15 can be inserted.

The recess 17, in its lower portion, which is associated with the base 12 of the housing 11, is provided with a border member 18. Border member 18, together with the section of the housing adjacent to it and with the base 12, forms a case-like receptacle. The housing of the drive block 15 with a lower section 19 shape corresponding to the form of the case-like receptacle is inserted in the receptacle.

Figure 4:
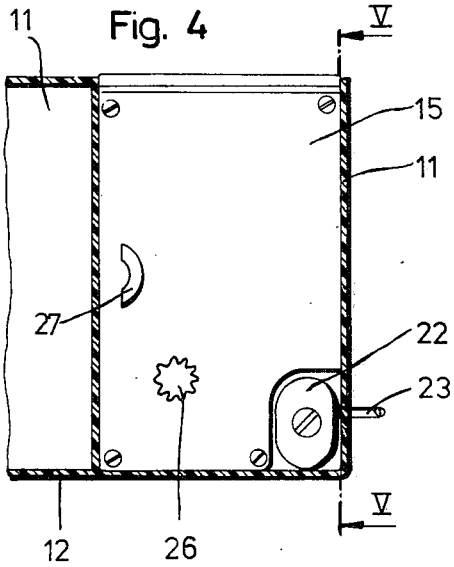
FIG. 4 is a view of the drive block of the household slicer in the section of the housing surrounding it, taken along the line IV—IV of FIG. 3.
Figure 5:
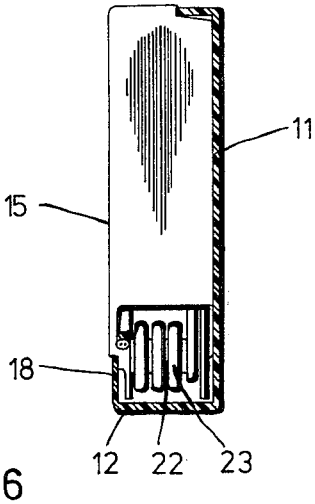
FIG. 5 is a view of the drive block of the household slicer to show the wind-up device, taken along the line V—V of FIG. 4.
Figure 6:
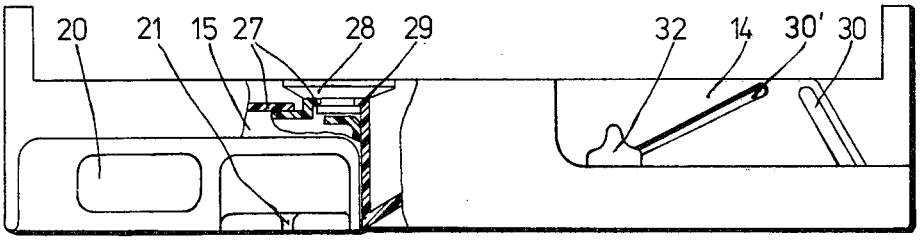
FIG. 6 is a top view of the housing of the household slicer on a larger scale with its wall in part broken away in order to show a bayonet joint serving to fasten the circular blade and the drive block.

The detachable unitary drive block 15 has various conventional switching and control elements which control the operation and the speed of the drive motor, such as a power switch 20 and a control designed as a sliding switch 21, and is equipped, as may be seen particularly from FIGS. 4 and 5, with a wind-up device 22 for a power cord 23 which can be connected to the electric power line. A cutout 24 for inserting the power cord 23 is provided in the side wall of the housing 11 defining the recess 17.

The recess 17 is closed off against the circular blade 16 by a partition provided with a cutout 25. If the drive block 15 is inserted into the housing 11, a drive pinion 26 which is mounted on its inner side facing the circular blade 16, protrudes through the partition. This drive pinion 26 meshes in the operating position with the teeth of the gear rim on the inside of the circular blade 16. A pocket 27 which extends toward the rear and is of nearly half-moon shape, is disposed at the housing of the drive block 16 on the side of the drive pinion 26. Pocket 27 engages a latch of a rotary knob 28 which serves to fasten the circular blade 16 and is designed with a bayonet joint. Another latch of the bayonet joint, on the other hand, engages behind a shoulder 29 which is likewise of approximately half-moon shape and is arranged at the housing 11, so that the circular blade 16 as well as the drive block 15 can be fastened simultaneously by means of the bayonet joint mounted at the rotary knob 28.

Figure 3:
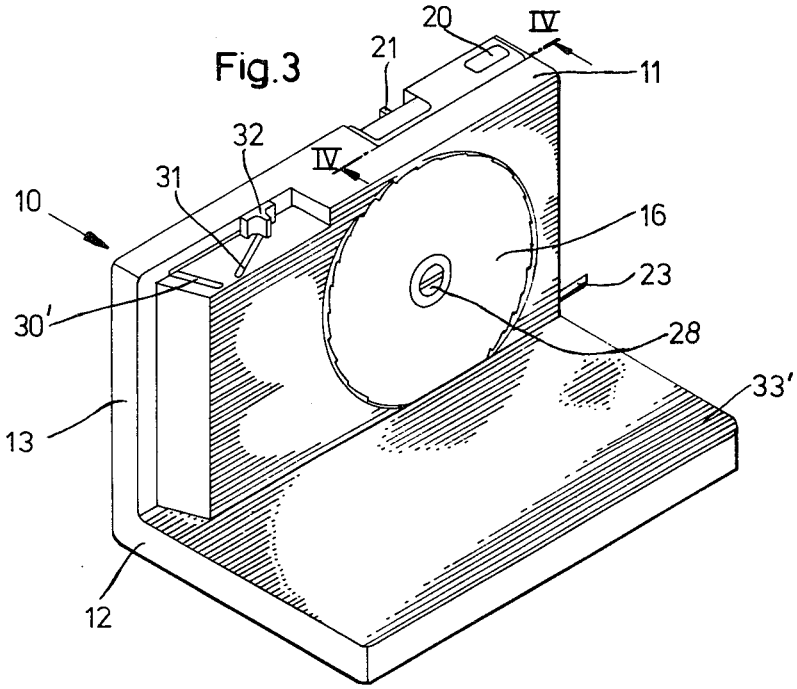
FIG. 3 is a household slicer in a view toward the circular blade, which is equipped with a fixed work plate.

The stop plate 14 at its upper and lower end face is equipped with guide slots 30 which are parallel to each other and with which pins 31 arranged in the frame-like section 13 of the housing 11 engage. Only one of these pins 31 is visible in FIG. 2. At the upper end face of the stop plate 14 there is another slot 30', into which a slider 32 supported at the frame 13 engages with a pin, not visible in the figure. This slider serves for setting the cutting thickness of the food to be cut. The household slicer 10 is equipped with a work plate 33 or 33' which is intended for the placement and the guiding of the food to be cut and which, in the embodiment example according to FIGS. 1 and 2 can be detached and folded up into the rest position, while in the embodiment example according to FIG. 3, it is fixed at the base 12 of the housing 11 of the household slicer 10.

If after extended use and, in particular, after cutting soft food, the household slicer 10 becomes dirty, the circular blade 16 as well as the drive block 15 are detached by opening the bayonet joint 28. Both parts can be taken off the housing 11, so that the latter can be cleaned or washed without difficulty.

The housing 11 is designed so that cavities and recesses arranged in it are equipped with runoffs which allow the water to run off unimpeded in at least one preferred position of the housing, so that the water cannot be retained. These runoffs may take the form of inclination of the walls of the housing, or may be gutters through which the water runs or may be openings in the wall where water may tend to accumulate. In this manner, it is ensured that the housing 11 of the household slicer 10 can also be washed in a dishwasher and then dried without difficulty.

There are claimed:

1. In a household appliance driven by an electric motor, such as a slicer for food, having a housing for the household appliance and an electric-motor drive mounted therein as well as switching and control elements controlling the operation, and a tool, such as circular blades and the like, that can be moved by the electric-motor drive and acts on the food to be operated on, the improvement comprising, (a) said electric-motor drive mounted in and enclosed in a separate housing of its own as a unitary drive block, (b) said housing of the household appliance at the flank of the housing on which the tool is mounted, has an at least approximately prismatic form standing on end, (c) said housing of the household appliance having a vertical partition wall with the circular blade tool on one side of the partition wall and the drive block on the other side of the partition wall, (d) a recess in the housing on the side of the housing opposite the tool, for inserting with a tight fit said drive block also having an at least approximately prismatic form, (e) with said recess equipped with a border member at the base of said housing, which border, together with vertical members of the housing extending from the base of the housing, form a case-like receptacle, and wherein said drive block has a lower section shaped to correspond to the lower end of the receptacle bounded by the border, and wherein the lower end of the drive block engages with said correspondingly shaped lower section of the receptacle bounded by the border, (f) an opening in the partition wall through which protrudes a drive pinion mounted on the inner side of the drive block facing the circular blade, (g) a gear rim on the inside of the circular blade with the drive pinion meshing with the teeth of the gear rim, and (h) a bayonet joint connection holding the circular blade mounted on the outside of the partition wall of the housing, and the unitary drive block mounted on the other side of the partition wall of the housing to the housing.

2. Household appliance according to claim 1, wherein the unit containing the drive block includes all elements such as a power switch, a slide switch and the like for electrically and mechanically influencing the drive.

3. Household applicance according to claim 2, wherein the drive block is equipped with a wind-up device for a power cord to be connected to a source of electric power.

4. Household appliance according to claim 1, wherein the housing for the household appliance having cavities and recesses are equipped with runoff means to permit water running off the housing to run off unimpeded and prevent retention of the water in the cavities and recesses.

* * * * *